United States Patent [19]

King

[11] Patent Number: 4,782,915

[45] Date of Patent: Nov. 8, 1988

[54] METHOD AND APPARATUS FOR SUSPENDING CLADDING FROM SCAFFOLDING

[75] Inventor: Peter King, Brampton, Canada

[73] Assignee: Anthes Industries Inc., Mississauga, Canada

[21] Appl. No.: 119,580

[22] Filed: Nov. 12, 1987

[30] Foreign Application Priority Data

Nov. 13, 1986 [CA] Canada ..... 522938

[51] Int. Cl.[4] ..... E04G 21/28; E04G 21/30

[52] U.S. Cl. ..... 182/129; 182/47; 52/63

[58] Field of Search ..... 182/129, 47, 179; 52/63

[56] References Cited

U.S. PATENT DOCUMENTS

| | | | |
|---|---|---|---|
| 1,514,038 | 11/1924 | Douglas | 52/63 |
| 3,121,470 | 2/1964 | Stone | 182/129 |
| 3,995,715 | 12/1976 | Virtanen | 182/47 |
| 4,044,523 | 8/1977 | Layher | 182/179 |
| 4,574,534 | 3/1986 | Beaton | 182/47 |
| 4,587,786 | 5/1986 | Woods | 182/179 |

*Primary Examiner*—Reinaldo P. Machado

*Attorney, Agent, or Firm*—Anthony J. Casella; Gerald E. Hespos

[57] ABSTRACT

An apparatus for suspending cladding or protective sheeting from scaffolding includes a first member detachably securable to an element of scaffolding, and a second member capable of attachment to said sheeting or cladding. The second member is adapted to hang from said first, thereby to hang the cladding or sheeting from scaffolding.

6 Claims, 3 Drawing Sheets

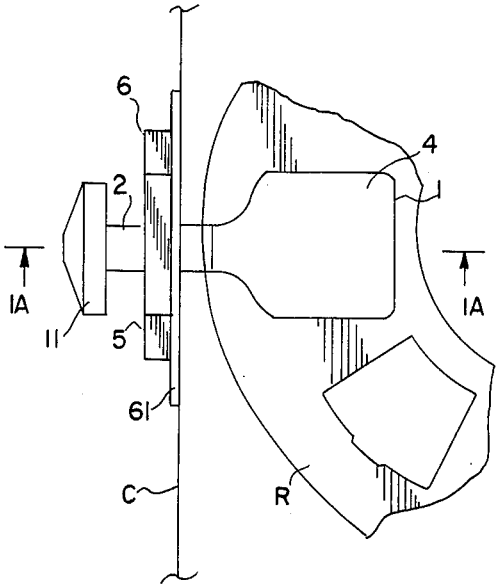
FIG. 1
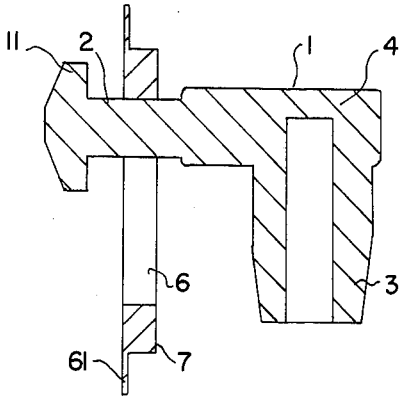
FIG. IA

METHOD AND APPARATUS FOR SUSPENDING CLADDING FROM SCAFFOLDING

The present invention relates to the field of scaffolding and scaffolding accessories.

It is very often desirable to suspend cladding or sheeting, such as polyethylene sheeting or polyvinylchloride fabric, from scaffolding. In this way, temporary structures such as weather shelters for heavy equipment at a construction site, can be easily fabricated. Also, the ability to suspend cladding on the outside of an access scaffolding structure makes it possible to do renovation work, brickwork, or other skilled labour requiring a dry environment, in almost any weather conditions.

In applicant's U.S. Pat. No. 4,587,786, issued May 13, 1986 for an invention entitled SCAFFOLDING AND LOCKING DISCS THEREFOR, a scaffolding is disclosed of the general type to which the present invention pertains. As well as with the scaffolding taught in that U.S. patent, the present invention can be used with the scaffolding taught in U.S. Pat. No. 4,044,523 (Layher).

In one broad aspect, the present invention relates to an apparatus for suspending cladding or protective sheeting from scaffolding, including a first member detachably securable to an element of scaffolding, and a second member capable of attachment to said sheeting or cladding, said second member being adapted to hang from said first, thereby to hang said cladding or sheeting from said scaffolding.

In another broad aspect, the present invention relates to a method of suspending cladding or protective sheeting from scaffolding, including the steps of: (a) attaching a plurality first member to an element of said scaffolding, said first member including an outwardly projecting suspension rod terminating in limiting means; (b) attaching a plurality of second members to said cladding or sheeting at intervals corresponding to the spacing of said first members on said scaffolding, said second members being provided with inverted key-hole shaped apertures; and (c) slipping said second members over said limiting means, onto the suspension rods of said first members, thereby to suspend said cladding or sheeting from said scaffolding.

In drawings which illustrate the present invention by way of example:

FIG. 1 is a top view of a cladding hanger and grommet of the present invention, the cladding hanger being inserted in a rosette of the type shown in Applicant's U.S. Pat. No. 4,587,786, only a portion of said rosette being shown;

FIG. 1A is sectional view through line 1A—1A in FIG. 1, but without further illustration of the rosette;

Referring to the Figures in general, the present invention provides a two-part system for hanging cladding C or sheeting from scaffolding of the type mentioned in the two U.S. patents referred to above. The upright standards of this type of scaffolding are provided with vertically spaced rosettes R, each one of which has eight spaced apertures or cut-outs.

The present invention includes a cladding hanging element 1, which can be removably affixed in the said apertures of the rosettes, and a grommet element 5, which is permanently welded to cladding or sheeting.

Figure 3A:
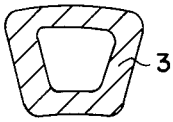
FIG. 3A is a cross-sectional view through line III—III in FIG. 2.
Figure 3B:
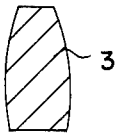
FIGS. 3B and 3C are the same views as FIG. 3A, of alternative embodiments of the post of the hanging element of the present invention.
Figure 3C:
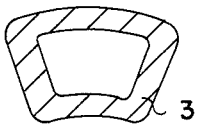

The cladding hanging element 1 includes a downwardly depending post 3 of a size and shape selected to fit snuggly within the cut-out of a rosette R as aforesaid. Three shapes of a post for use in association with the three shapes of cut-out prevalent in current scaffolding, are illustrated in FIGS. 3A–3C. FIG. 3A is a cross-section of an arcuate shaped post, for use with rosette cut-outs such as those shown in Applicant's aforementioned U.S. patent. FIGS. 3B and 3C show generally barrel and arcuate shaped posts for use with the scaffolding taught in the aforementioned Layher patent.

Figure 2:
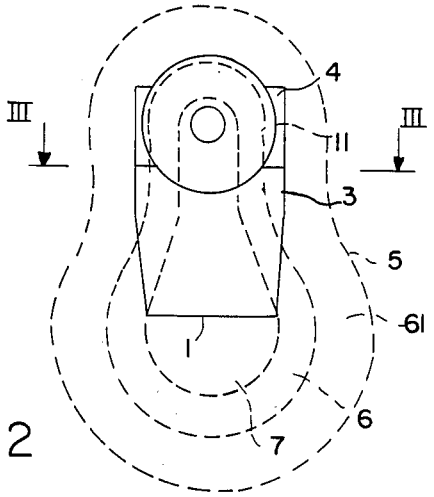
FIG. 2 is a front view of the cladding hanger illustrated in FIG. 1, with the grommet being shown in phantom.

In FIG. 2, it can be seen that the post 3 of the cladding hanging element 1 is tapered inwardly near its end. This feature is slightly exaggerated in FIG. 2, for illustrative purposes. This taper permits the post to be inserted in a rosette cut-out very easily. Moreover, the post 3, which is integral with the remainder of the cladding hanging element and made from a high-impact plastic, such as Dupont Zytel ST301 Nylon, is preferably hollow, so that heat shrinking and warping during manufacture will be limited. The post is dimensioned to be very snuggly driven into a rosette cut-out. It will be noted that the FIG. 3B barrel-shaped post is not hollow. This is because of its small size.

Mounted atop the post and integral therewith is a support member 4, and extending outwardly therefrom (radially outwardly, relative to a rosette or a standard), is a rod-like hanging member 2. A disk or button-shaped member 11 is located on the end of the hanging member or rod 2 in the embodiment illustrated in FIGS. 1, 1A and 2.

The second part of the system of the present invention is a grommet 5. In one embodiment, the grommets of the present invention are basically inverted plastic key-holes which are welded, at regular vertical and horizontal intervals, to cladding or sheeting. The intervals correspond vertically to the typical spacing of rosettes on a standard—one meter, and horizontally to the typical length of a ledger between standards—3 meters. As can be seen from FIG. 2, the aperture 7 in grommet 5 for use with the hanging element shown in FIGS. 1, 1A and 2, is generally pear-shaped. Of course, any exterior shape may be utilized. What is more important is that the aperture or cut-out 7 in this grommet 5, into which the disk 11 and rod 2 hanger of the cladding hanging element of the present invention will be inserted, is shaped as an inverted key-hole. This is because, to hang cladding on the cladding hanging element 1, one slips the grommet 5 over the disk 11, and then allows the grommet 5—with cladding attached, to hang freely on the rod 2. With a cut-out in the shape of an inverted key-hole, the grommet 5 will slide down the hanging rod 2 of the cladding hanging element 1, to rest securely on same. Moreover, the walls of the channel portion of the key-hole of the grommet, in a preferred embodiment, converge toward one another in the middle of their respective lengths, so that the distance between them at that point is slightly less than the diameter of the rod. In this way, when the grommet 5 is slipped over the rod 2, securement of the cladding to the scaffolding is improved.

Figure 4:
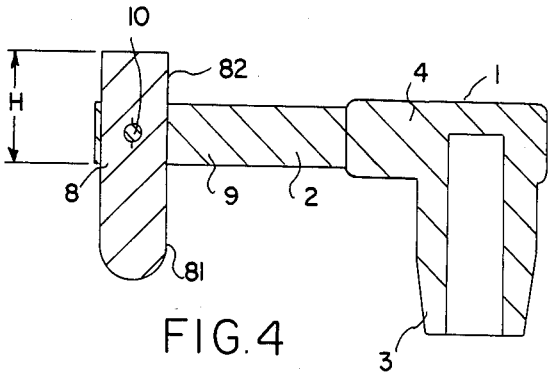
FIG. 4 is the same view as FIG. 1A, of an alternative embodiment of the hanging element of the present invention.
Figure 5:
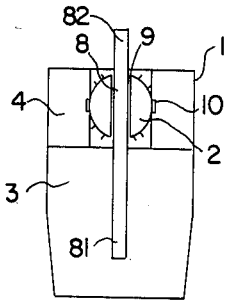
FIG. 5 is a front view, of the hanging element of the embodiment of FIG. 4.
Figure 6:
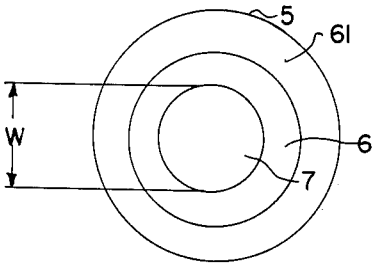
FIG. 6 is a front view of a grommet for use with the hanging element illustrated in FIGS. 4 and 5.

Referring next to the embodiment of the present invention illustrated in FIGS. 4, 5 and 6, it will first be noted that the post 3 of the hanging element 1 of the embodiment is the same as that described above. The difference in the hanging element 1 is that the rod 2 thereof is not provided with a disk 11 or bottom-like member at its end. Rather, it is slotted, and provided with a swiveling drop lock retainer 8.

The retainer 8 is held in a slot 9 in the rod 2 by means of a rivet 10, which rivet passes through the retainer 8 at such a point that one end 81 of the retainer is about twice as long as the other end 82. This is so that when the retainer 8 is permitted to swivel freely, it will remain in an upright position which, as explained below, will retain a grommet 5 on the rod 2 of the hanging element.

The slot 9 in which the retainer pivots extends from the end of the rod inwardly a depth just less than the length which would be required for the retainer to rotate fully. That is, the short end 82 of the retainer can pass freely through the slot, but the long end 81 cannot.

The central aperture 7 of the grommet of this embodiment is circular, and has a diameter W wider than the rod, but not as wide as the distance H from the bottom of the rod to the top of the retainer (see FIG. 4).

To install the grommet 5, with its attached cladding, on the hanging element 1 of FIGS. 4 and 5, one swings the retainer 8 outwardly so that it is more or less an extension of the rod 2. Then the grommet 5 is slipped over the retainer 8 and onto the rod 2, and the retainer 8 is allowed to drop to an upright position. The grommet 5 will now be retained securely on the rod, because outward motion of the grommet 5 along the rod will be impeded by the top end 82 of the retainer 8.

It will be noted that around the aperture 7 in either embodiment of the grommet 5, there is a thickened, step-like portion 6. This is to strengthen the parts of the grommet 5 encountering the greatest stress. The opposite surface 61 of the grommet 5, though, is flat and outwardly flanged, so that a large surface area can be welded to the cladding (by heat, or an adhesive, or a combination of the two) thereby ensuring secure engagement of the grommet to the cladding.

It will be understood that the foregoing description of examples is not meant to limit the scope of the invention, as described in the appended claims.

I claim:

1. An apparatus for suspending cladding or protective sheeting from scaffolding, including a first member detachably securable to an element of scaffolding, and a second member capable of attachment to said sheeting or cladding, said second member being adapted to hang from said first, thereby to hang said cladding or sheeting from said scaffolding, wherein said first member comprises:

(i) a post insertable in an apparatus formed in a rosette which extends radially from said scaffolding, said post having side walls which taper inwardly from top to bottom, to fit snuggly in the apertures in said rosettes;

(ii) an intermediate support member atop said post and integral therewith;

(iii) a cylindrical rod-like member extending radially outerwardly from said intermediate support member, relative to said scaffolding, said rod-like member being integral with said intermediate support member and capable of accommodating said second member;

(iv) limiting means on the end of said rod-like member, to prevent said second member from slipping off said rod-like member.

2. An apparatus as described in claim 1, wherein said second member is a grommet with a central aperture of a size and shape selected to fit over said rod-like member, and be prevented from slipping off said rod-like member by said limiting means.

3. An apparatus as described in claim 2 wherein said grommet has a flat surface for attachment by heat welding to said cladding and, opposite said flat surface, a surface which is provided with a thickened step-like portion around said aperture, to reinforce and strengthen said grommet where it will contact said rod-like member.

4. An apparatus as described in claim 3, wherein said limiting means on the end of said rod-like member is a disk co-axial therewith, and said aperture in said grommet is shaped like an inverted key-hole, with a rounded portion at its bottom, through which said disk can pass, and a channel portion at its pass, which is of a size selected to fit over said rod-like member, but not allow passage therethrough of said disk.

5. An apparatus as described in claim 4, wherein the sides of said channel portion of said aperture in the grommet converge slightly near the middle of said channel portion, so that when the grommet is fitted over the rod-like member, it will be retained thereon by slight inward biasing of the edges of channel portion of the aperture against the rod-like member

6. An apparatus as described in claim 3, wherein said aperture in said grommet is round, and said limiting means on the end of said rod-like member is a swiveling retainer captive in a slot in the rod-like member by a rivet passing through said rod-like member and said retainer, said retainer having a long end below said rivet tending to keep it, by gravity, in an upright position, and a short end projecting above said rod-like member when said retainer is in an upright position to prevent said grommet from slipping off said rod-like member the diameter of said aperture being less than the distance from either end of said retainer in an upright position to the opposite edge of said rod-like member, whereby to remove said grommet from said rod-like member, it is necessary to manipulate said retainer, to a horizontal position, said retainer having a width less than the diameter of said aperture in said grommet.

* * * * *